US008181674B2

(12) United States Patent
Schwartz

(10) Patent No.: US 8,181,674 B2
(45) Date of Patent: May 22, 2012

(54) WIRE BUNDLE TWISTER AND COMBER

(75) Inventor: Christopher F. Schwartz, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 1069 days.

(21) Appl. No.: 11/852,944

(22) Filed: Sep. 10, 2007

(65) Prior Publication Data

US 2009/0065091 A1 Mar. 12, 2009

(51) Int. Cl.
*B21F 7/00* (2006.01)
*B21F 15/04* (2006.01)

(52) U.S. Cl. ..... 140/118; 140/149

(58) Field of Classification Search ..... 140/30, 140/36, 39, 45, 93.6, 117–120, 123, 123.5, 140/147, 149; 81/485, 488, 489; 57/1 UN, 57/2.3

See application file for complete search history.

(56) References Cited

U.S. PATENT DOCUMENTS

| | | | | |
|---|---|---|---|---|
| 348,293 | A * | 8/1886 | Reinheimer | 140/120 |
| 852,216 | A * | 4/1907 | Bowman | 140/117 |
| 1,705,369 | A * | 3/1929 | Leach | 140/119 |
| 2,881,582 | A * | 4/1959 | Robbins | 57/3.5 |
| 3,198,220 | A * | 8/1965 | Scamberti | 140/119 |
| 6,976,512 | B2 * | 12/2005 | Loeffler et al. | 140/147 |
| 7,073,541 | B2 * | 7/2006 | Pappas | 140/123 |
| 2002/0104577 | A1 * | 8/2002 | McGroarty | 140/147 |

* cited by examiner

*Primary Examiner* — Teresa Ekiert
(74) *Attorney, Agent, or Firm* — Felix L. Fischer

(57) ABSTRACT

A wire harness bundle twister and comber employs a comber plate having a plurality of apertures receiving a plurality of wire bundles in sliding engagement with handles extending from the comber plate for rotation of the plate to twist the wire bundles into a consolidated wire harness. To allow removal of the wire bundles from the bundle twister and comber without withdrawing the wire bundles to an end the comber plate incorporates an upper outer plate element and a lower outer plate element concentric with and separable from a first inner or center element to separate the apertures into segments for removal of the wire bundles.

4 Claims, 7 Drawing Sheets

WIRE BUNDLE TWISTER AND COMBER

BACKGROUND OF THE INVENTION

1. Field of the Invention

Embodiments of the disclosure relate generally to the field of wire harness fabrication tools and more particularly to a method and apparatus separating or "combing" wire bundles in the harness while allowing ergonomically efficient twisting of the entire wire harness for consolidation.

2. Description of the Related Art

Fabrication of wire harnesses for aircraft and other high technology vehicles or large scale devices requires high quality and consistency of wrapping or twisting of the wire harness for efficient packaging. As an example, DPS 1.34-51, a military specification for metal braided harnesses, requires all wires to do one complete twist every 4 to 12 inches. Harnesses are typically created by a combination of separate wire bundles each having individual wires of differing sizes and being of different size in the aggregate than other bundles in the harness. For most applications, wire harness fabrication is conducted using many manual operations.

Handling large wire harnesses can be very tiring and wrapping requirements can lead to repetitive motion injuries in some instances. Additionally, when twisting by hand accuracy of determining that all wires have been twisted to required specifications is challenging.

It is therefore desirable to tooling which provides ergonomic leveraging for twisting of wire harnesses while providing combing of individual bundles for an even wrap.

It is further desirable to provide such tooling with flexibility for extraction of the tool at division points in the harness without un-threading individual bundles through the tool.

SUMMARY OF THE INVENTION

An exemplary embodiment of a method incorporating the present invention provides a wire harness bundle twister and comber with a comber plate having a plurality of apertures receiving a plurality of wire bundles in sliding engagement with handles extending from the comber plate for rotation of the plate to twist the wire bundles into a consolidated wire harness.

To allow removal of the wire bundles from the bundle twister and comber without withdrawing the wire bundles to an end the comber plate in certain embodiments incorporates an upper outer plate element and a lower outer plate element concentric with and separable from a first inner or center element to separate the apertures into segments for removal of the wire bundles.

In an alternative embodiment for flexible sizing of the apertures engaging the wire bundles the comber plate employs an outer ring having a spaced set of radial bores, the first inner element incorporates a matching hole set and a number of rods are received through the bores in the outer ring and the holes in the first element. The outer ring, first element and rods cooperatively form the plurality of apertures to receive the wire bundles. Selectively inserting the rods into predetermined bores and corresponding holes varies the aperture size.

A method for employing the embodiments described includes inserting wire bundles into the apertures for sliding engagement and rotating the handles to twist the wire bundles into a consolidated wire harness while moving the comber plate along the bundle length. For the separable inner and outer elements each wire bundle is inserted into the aperture segments in the first element and the upper and lower outer plate elements are attached to cooperatively form the apertures restraining the wire bundles. Additionally for "Ys" or other terminations of the harness intermediate the ends, removing at least one of the upper and lower outer plate elements allows the apertures associated with the first element and the at least one of the upper and lower outer plate elements to be opened for removing wire bundles from the opened apertures.

BRIEF DESCRIPTION OF THE DRAWINGS

The features and advantages of embodiments disclosed herein will be better understood by reference to the following detailed description when considered in connection with the accompanying drawings, including prior art from the University of North Carolina, wherein.

DETAILED DESCRIPTION OF THE INVENTION

Figure 1A:
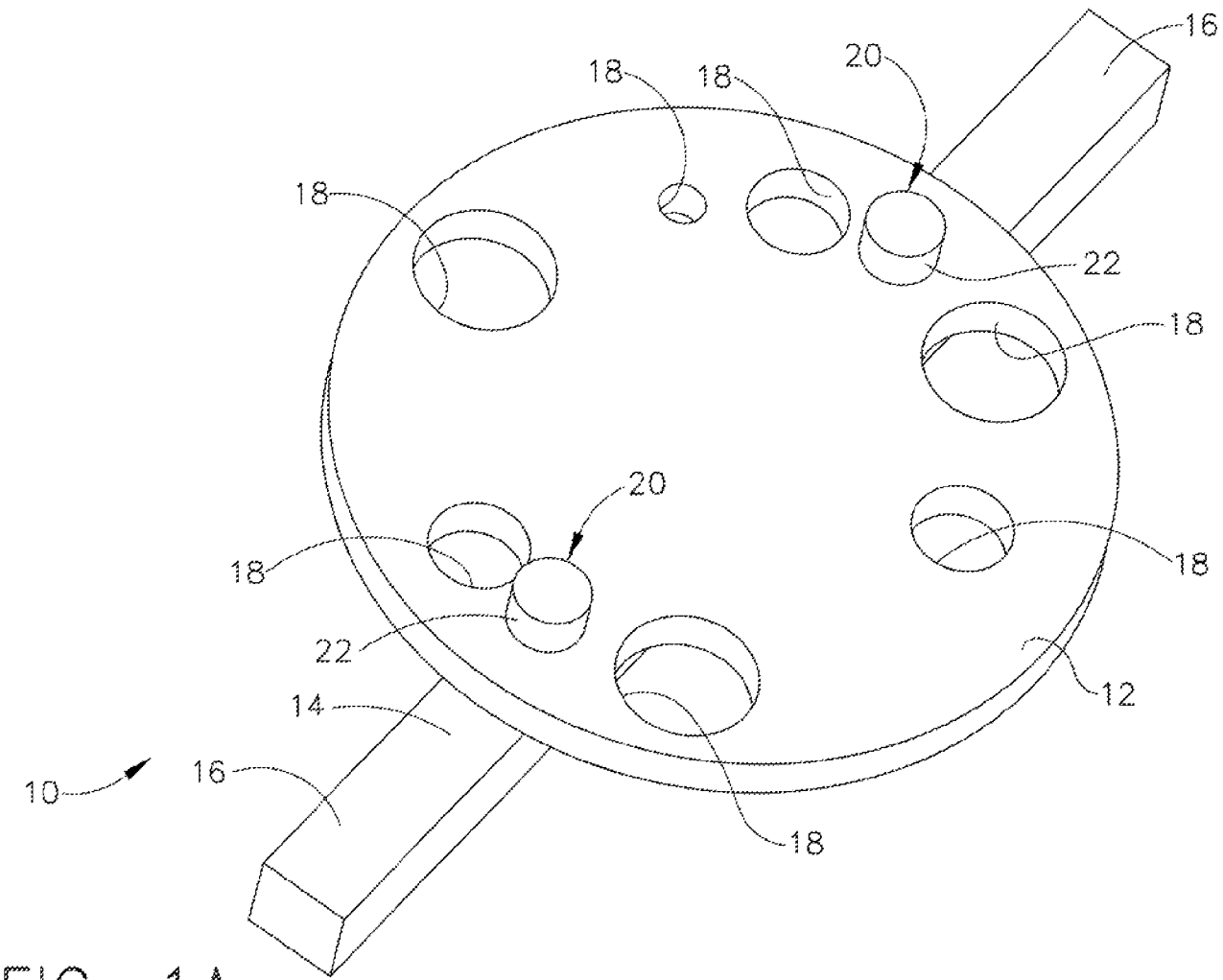
FIG. 1A is an isometric view of an exemplary first embodiment of a wire bundle twister and comber according to the present invention.

A first embodiment for a wire harness bundle twister and comber 10 is shown in FIG. 1A. A comber plate 12 is carried by a manipulator bar 14 with handles 16 extending beyond the periphery of the comber plate for operation as will be described in greater detail subsequently. Multiple apertures 18 in the comber plate received individual wire bundles (or individual wires). In the embodiment shown, the apertures are of varying diameter to accommodate various bundle sizes. For the embodiment shown, the comber plate is attached to the manipulator bar using threaded fasteners 20 with knurled heads 22 for easy removal. In an exemplary embodiment, the comber plate is fabricated from ½ inch thick Lexan® plastic.

Figure 1B:
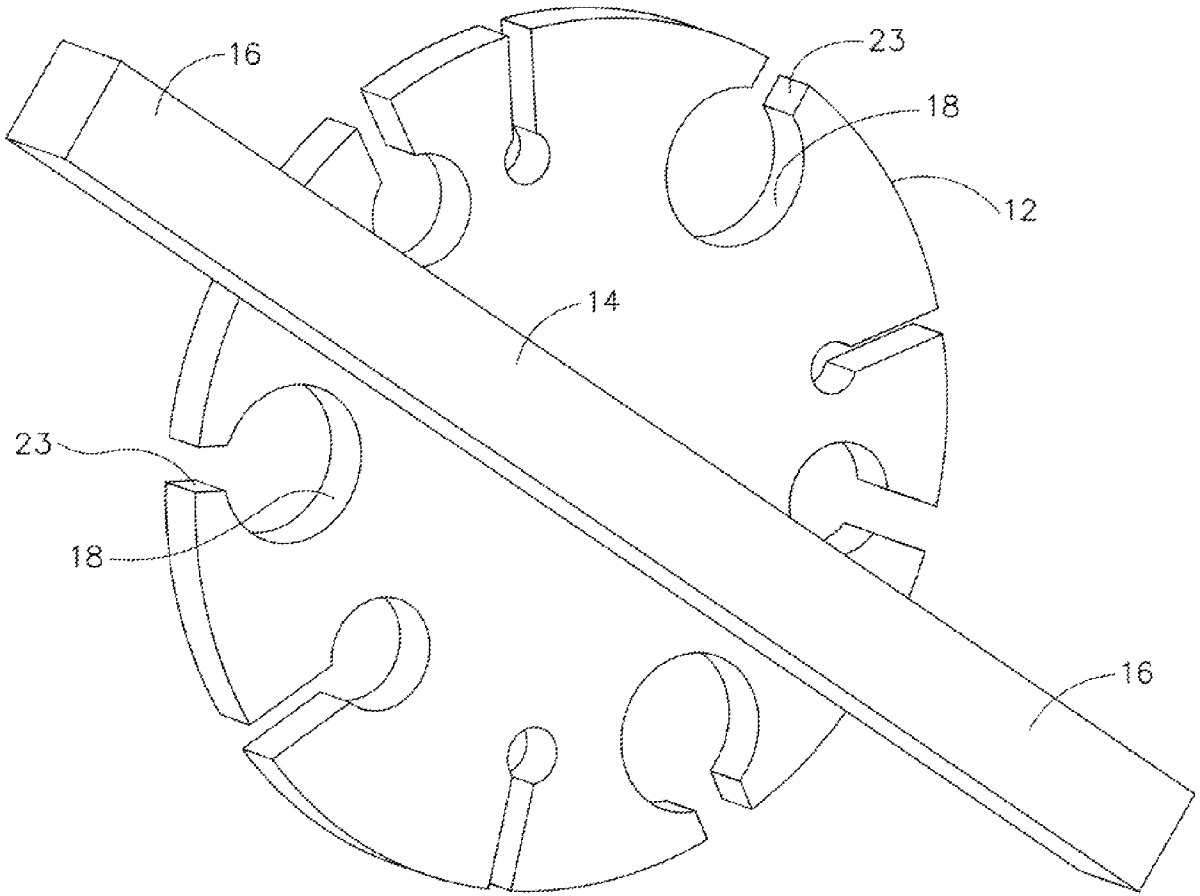
FIG. 1B is an isometric view of the first embodiment with added cutouts for insertion of wire bundles into the apertures.

FIG. 1B shows a rear view demonstrating the manipulator bar and the addition of cutouts or slots 23 from the apertures to the periphery of the comber plate which allow insertion of wire bundles into the apertures.

Figure 2:
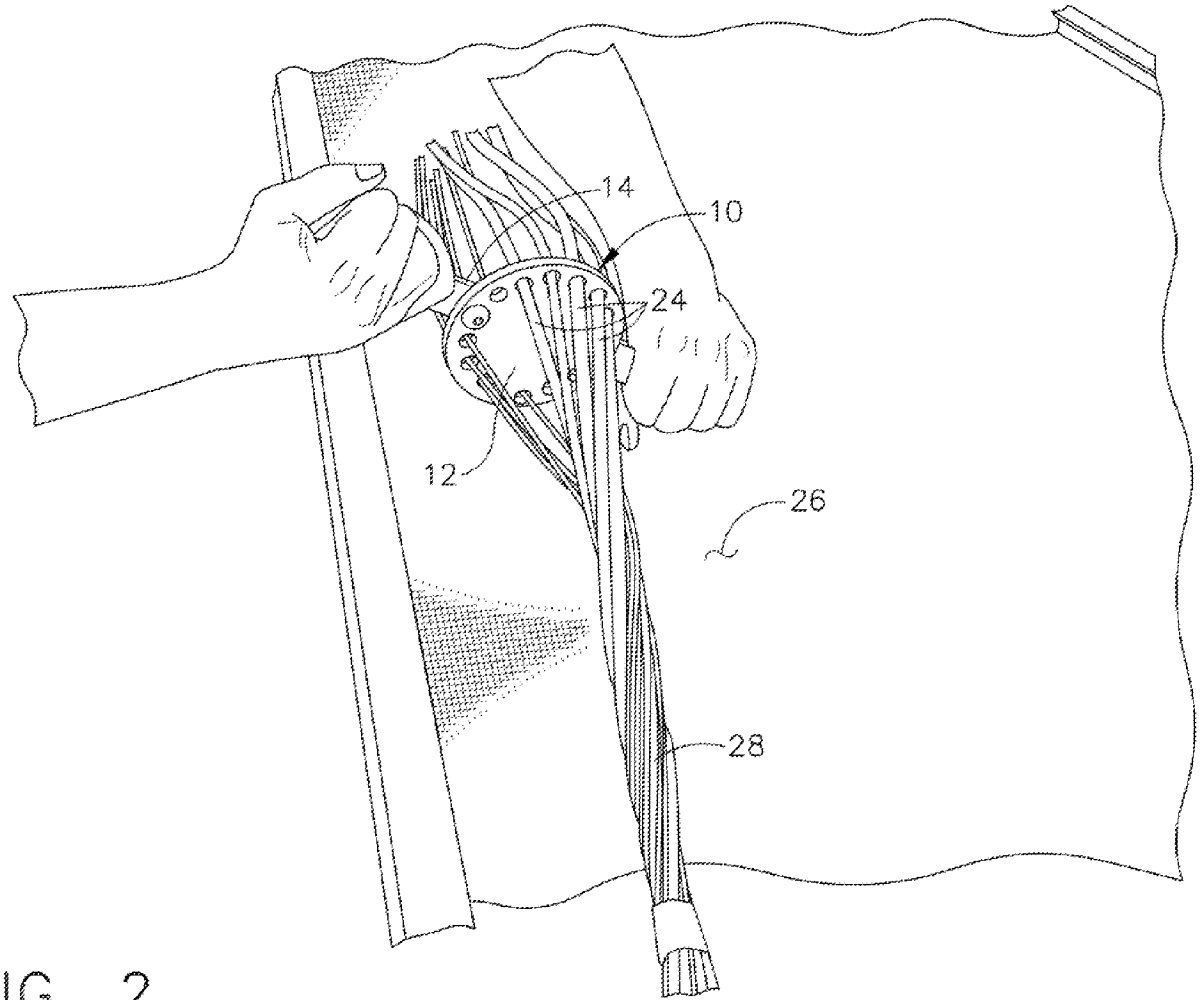
FIG. 2 is a schematic view of a wire bundle twister and comber of the second embodiment in use.

As shown in FIG. 2, individual wire bundles 24 are threaded through the apertures in the comber plate or, as will be described with alternate embodiments subsequently draped into aperture segments which are then closed. Drawing the comber plate along the length of the bundles segregates each bundle for easy handling. The handles allow twisting of the bundles of the harness to achieve a desired consolidation of the overall harness including easy measurement of the number twists inserted along the length of the harness. The leverage provided by the handles on the device greatly reduces hand fatigue and twist time. In many cases it also eliminates the need for a second person to tape the bundle while the other holds the twist in the wires. The handles on the device when placed on a table 26 act as a brace to hold the twist so the operator has both hands free to spot tape the consolidated bundles in the harness 28.

Figure 3:
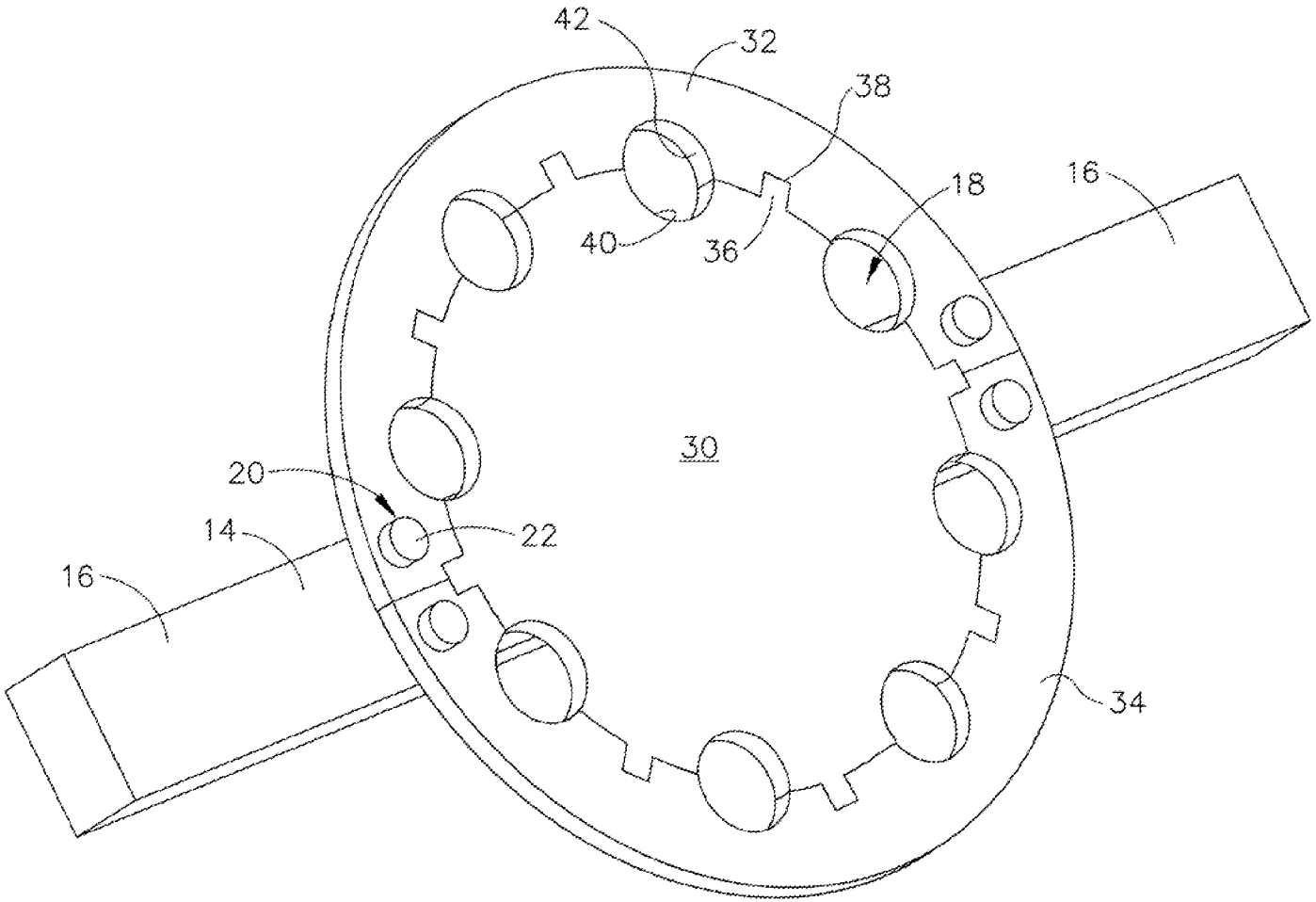
FIG. 3 is an isometric view of a second exemplary embodiment of the wire bundle twister and comber.

For certain harness applications, removal of the bundle twister and comber between the ends of the harness is desirable. This may be required where "Ys" in the harness are present with certain bundles segregated from other bundles in the harness. FIG. 3 shows a second embodiment of the invention which accommodates insertion in and removal of the bundle twister and comber without threading the individual bundles from a free end through the apertures in the comber plate. The comber plate 12' incorporates an inner plate 30 which is integral to or carried by manipulator bar 16. Semicylindrical outer plate elements 32 and 34 are removably attached to the manipulator bar with the bundle receiving apertures 18 split substantially diametrically between the inner plate and outer plate elements. For the embodiment shown, threaded fasteners 20 with knurled heads 22 are again employed to allow easy attachment of the outer plate elements to the manipulator bar. Indexing splines 36 extending from the inner plate are received in mating slots 38 in the outer plate elements for alignment of the aperture segments and to further enhance rigidity of the assembled comber plate.

While shown in the embodiment of the drawings as separate elements with threaded fastener attachment, in alternative embodiments one or both of the outer plate elements are affixed to the manipulator bar with hinges to allow opening of the apertures for removal of the wire bundles but constraining the individual portions of the apparatus to prevent loss of parts. Additionally, while the manipulator bar is shown attached to a surface of the comber plate, the comber plate integrally incorporates the manipulator bar and handles in a substantially planar arrangement.

Figure 4:
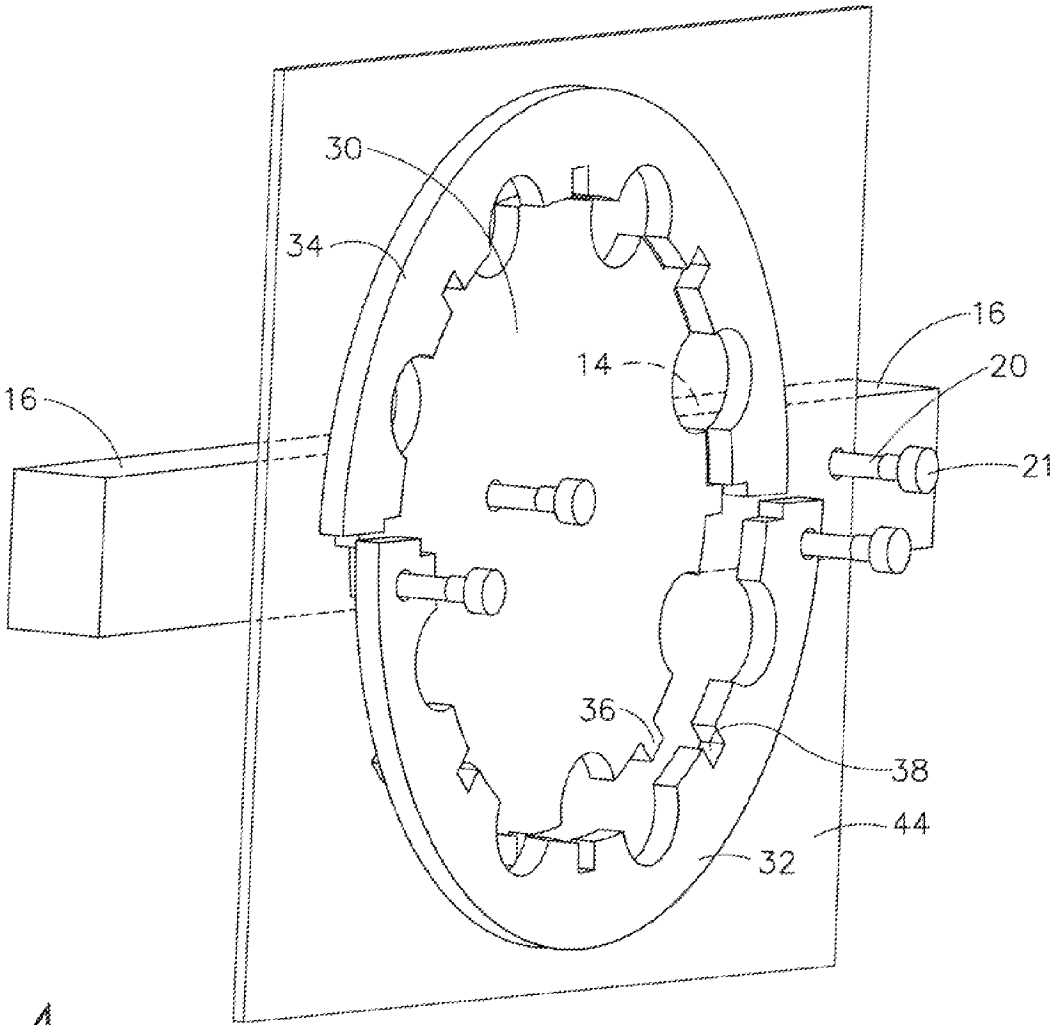
FIG. 4 is at exploded view of the embodiment of FIG. 2 further demonstrating a "punch through" retainer.
Figure 5:
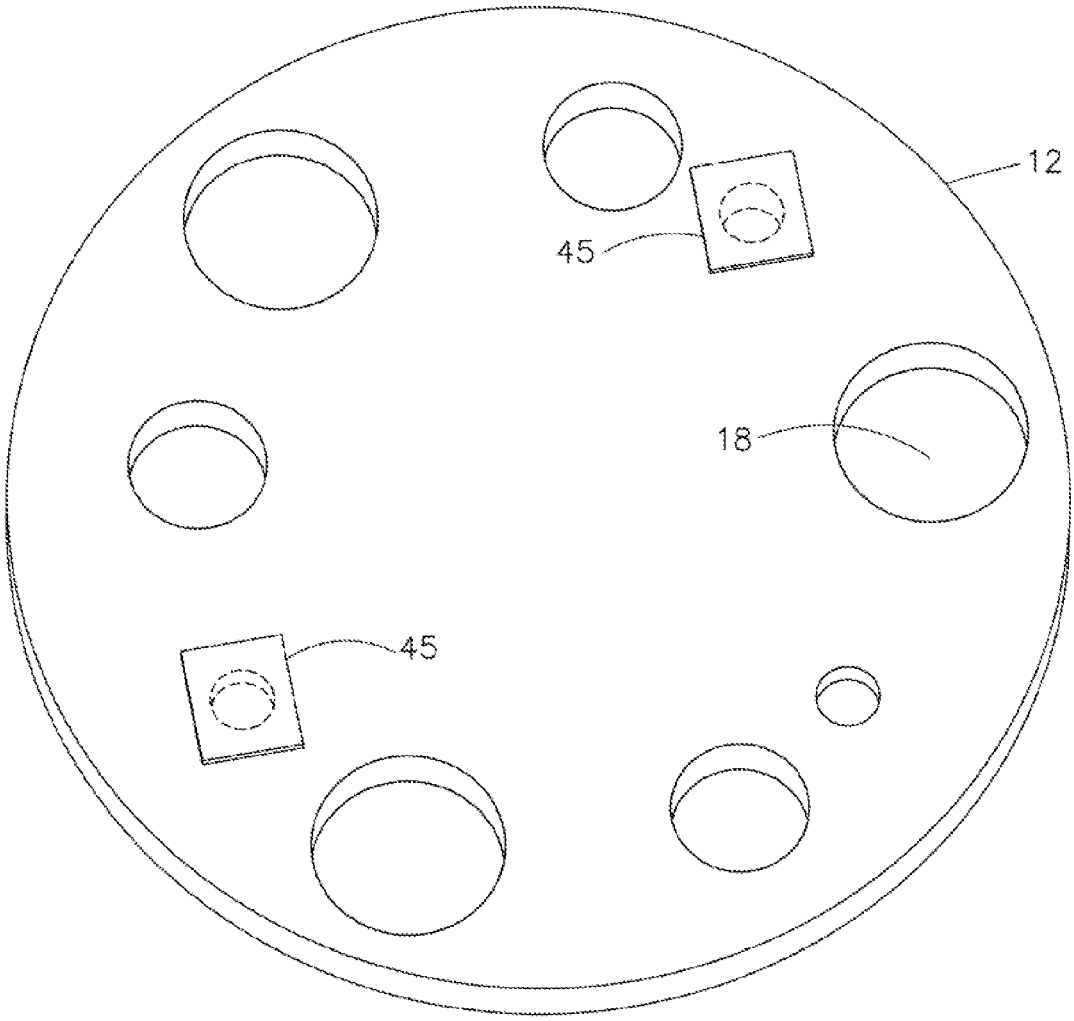
FIG. 5 is a rear view of the comber plate showing tensioning patches applied to selected apertures; and, FIG. 6 is an isometric view of a third embodiment of the wire bundle twister and comber.

FIG. 4 shows the second embodiment with the outer plate elements disengaged from the manipulator bar in exploded view for additional clarity. A tensioning sheet 44 is also shown which is adhesively affixed to the comber plate. For wire bundles having a small number of wires or consisting of individual wires, maintaining tension consistent with the tension in larger bundles during use of the tool may be difficult. The tensioning sheet allows the smaller or individual bundle wires to pierce the sheet thereby providing a close fit with frictional tensioning supplementing the combing of the bundles through the apertures as the harness bundle twister and comber is drawn along the harness. In an exemplary embodiment the tensioning sheet is fabricated from silicon rubber. For the embodiment shown in the drawings the tensioning sheet extends over the entire combing plate covering all apertures. In alternative embodiments such as that shown in FIG. 5, the tensioning sheet is in the form of patches 45 which are adhesive backed and individually placed over selected apertures in the comber plate. Alternatively, the tensioning sheet is fabricated with certain mating holes for selected apertures in the comber plate prepunched.

For operation, the outer plate elements are removed and the individual wire bundles draped into the aperture segments 40 on the inner plate. The outer plate elements are then secured to the manipulator bar capturing the individual wire bundles in the complete apertures created by the mating aperture segments 42 on the outer plate elements. If a tensioning sheet is used, individual bundles requiring tensioning are fed from an end termination to puncture the tensioning sheet. For removal of the tool from the harness prior to reaching end terminations of the bundles, the outer plate elements are disassembled from the manipulator bar allowing the individual wire bundles to be removed from the apertures and the center plate and manipulator bar extracted from the harness and bundles. If a tensioning sheet is employed, the sheet may be cut or slotted for removal from the tensioned bundles.

Figure 6:
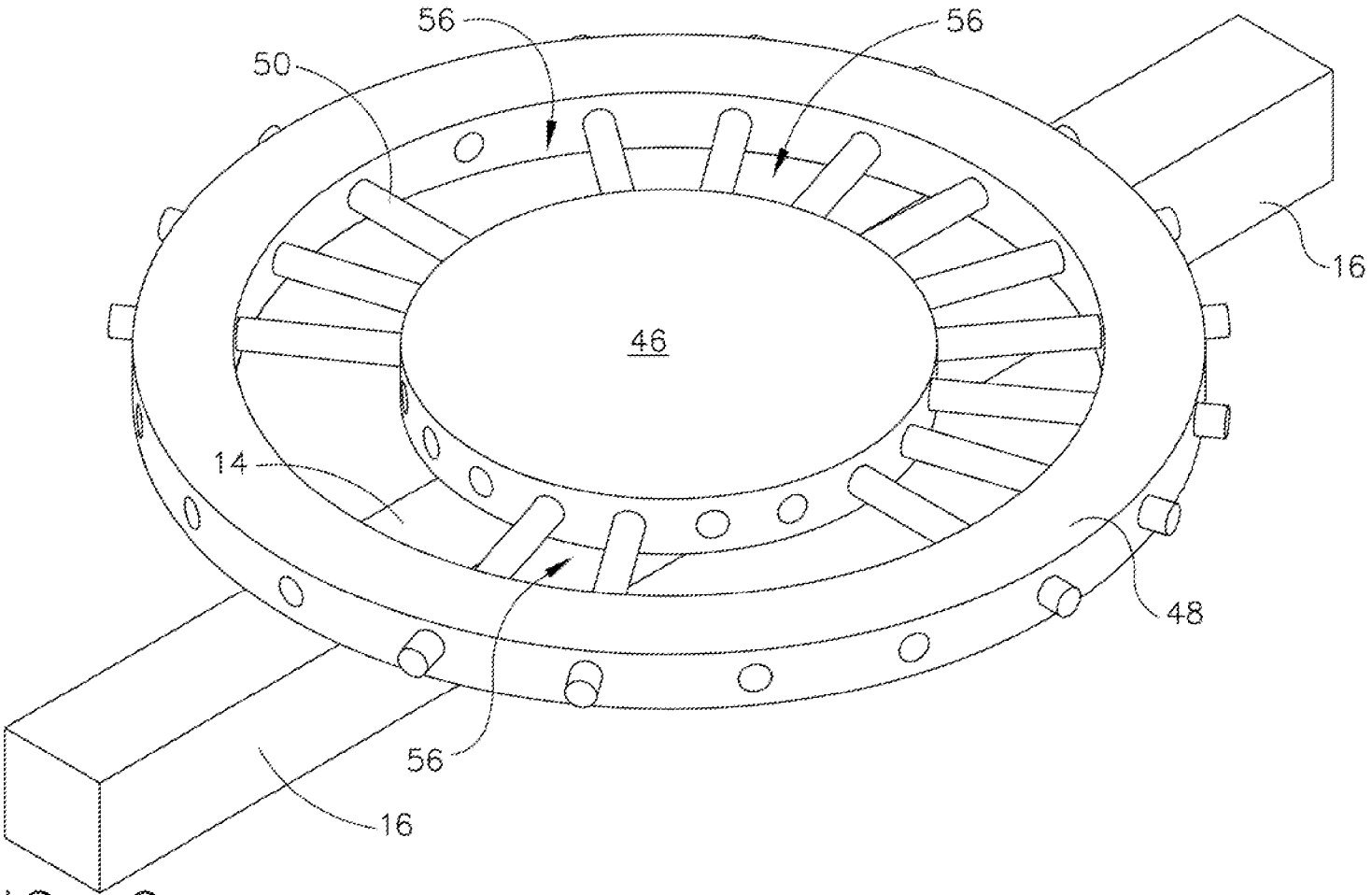

As shown in the first embodiment multiple aperture sizes may be desirable to accommodate differing diameters of the bundles incorporated into the harness. For mass production of identical or similar harnesses, creating a comber plate with defined aperture sizes as shown in the first embodiment creates a simple and effective tool. To provide flexibility in accommodating differing bundle diameters for common use of the tool on different harness designs, adjustment of the effective aperture size to accommodate the different diameters is desirable. A third embodiment of the bundle twister and comber provides for adjustment of the relative aperture size. As shown in FIG. 6, a center plate 46 is carried by manipulator bar 14 an outer ring 48, which may be a single element as shown in the drawing or two split elements comparable to the outer plate elements of the second embodiment for intermediate removal of the harness, is attached to the center plate using rods 50 inserted through bores 52 in the outer ring and received in holes 54 in the center plate. Providing multiple rods with associated bores and holes allows selection of a desired aperture size for multiple trapezoidal apertures 56. While not circular in shape, the apertures provide effective segregation and combing of the individual bundles while accommodating a wide range of bundle diameters. The connecting rods provide resisting elements in the comber plate to twist the bundles in the harness as desired.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A method for wrapping of wire harnesses comprising:

providing a comber plate having a plurality of apertures and handles extending from the comber plate for rotation of the plate wherein the comber plate comprises a first central element and an upper outer plate element and a lower outer plate element separable from the first central element to separate the apertures into segments the first central element and upper and lower outer plate elements cooperatively forming the apertures to receive the wire bundles;

inserting each wire bundle into at least a portion of the aperture segments in the first element;

attaching the upper and lower outer plate elements to cooperatively form the apertures restraining the wire bundles;

providing a tensioning sheet over at least a portion of the apertures through which wire bundles have not been inserted;

inserting a wire bundle into the portion of the apertures piercing the tensioning sheet with each wire bundle to maintain tension in the wire bundle during combing; and rotating the handles to twist the wire bundles into a consolidated wire harness.

2. A method as defined in claim 1 further comprising the steps of:

removing at least one of the upper and lower outer plate elements to open apertures associated with the first element; and removing wire bundles from the opened apertures.

3. A method as defined in claim 1 wherein the step of providing a tensioning sheet comprises:

selecting apertures in the comber plate through which wire bundles with small numbers of wires will be inserted;

covering the selected apertures with tensioning sheet patches;

and wherein the step of inserting the wire bundles further comprises piercing the tensioning sheet patches at the selected apertures with the associated wire bundle to maintain tension in the wire bundle during combing.

4. A method for wrapping of wire harnesses comprising:

providing a comber plate having a plurality of apertures and handles extending from the comber plate for rotation of the plate wherein the comber plate comprises a first element and an upper outer plate element and a lower outer plate element separable from the first element to separate the apertures into segments the at first element and upper and lower outer plate elements cooperatively forming the apertures to receive the wire bundles;

adhesively attaching a tensioning sheet to a surface of the comber plate;

inserting each wire bundle into the aperture segments in the first element piercing the tensioning sheet with each wire bundle to maintain tension in the wire bundle during combing;

attaching the upper and lower outer plate elements to cooperatively form the apertures restraining the wire bundles;

drawing the comber plate along the wire bundles to comb he bundles prior to wrapping into the harness; and rotating the handles to twist the wire bundles into a consolidated wire harness.

* * * * *